US008754921B2

(12) United States Patent
Hirano

(10) Patent No.: US 8,754,921 B2
(45) Date of Patent: Jun. 17, 2014

(54) IMAGE FORMING APPARATUS AND CONTROL METHOD THEREOF

(75) Inventor: Masayuki Hirano, Matsudo (JP)

(73) Assignee: Canon Kabushiki Kaisha (JP)

( * ) Notice: Subject to any disclaimer, the term of this patent is extended or adjusted under 35 U.S.C. 154(b) by 1162 days.

(21) Appl. No.: 12/169,359

(22) Filed: Jul. 8, 2008

(65) Prior Publication Data

US 2009/0016752 A1 Jan. 15, 2009

(30) Foreign Application Priority Data

Jul. 9, 2007 (JP) ..... 2007-180156

(51) Int. Cl.
*B41J 2/47* (2006.01)
*B41J 2/435* (2006.01)

(52) U.S. Cl.
USPC ..... 347/253; 347/237; 347/247

(58) Field of Classification Search
USPC ..... 347/237, 247, 253
See application file for complete search history.

(56) References Cited

U.S. PATENT DOCUMENTS 4,794,413 A * 12/1988 Yamazaki et al. ..... 347/247
4,821,065 A * 4/1989 Ishii et al. ..... 347/236
5,089,848 A * 2/1992 Kusuda et al. ..... 399/31
5,153,609 A * 10/1992 Ando et al. ..... 347/129
5,687,002 A * 11/1997 Itoh ..... 347/133
6,956,598 B2 * 10/2005 Fujiwara ..... 347/246
7,196,717 B2 * 3/2007 Mori et al. ..... 347/252
7,443,413 B2 * 10/2008 Jodra et al. ..... 347/247
7,750,934 B2 * 7/2010 Yoshida ..... 347/246
2003/0058325 A1 * 3/2003 Fukui ..... 347/133

FOREIGN PATENT DOCUMENTS

JP 2005-66827 A 3/2005
JP 2005070069 A 3/2005

OTHER PUBLICATIONS

Japanese Office Action issued in counterpart application No. JP2007-180156, dated Apr. 27, 2012.

* cited by examiner

*Primary Examiner* — Uyen Chau N Le
*Assistant Examiner* — John M Bedtelyon
(74) *Attorney, Agent, or Firm* — Rossi, Kimms & McDowell LLP

(57) ABSTRACT

A storage stores data of charging electric potentials at two or more points on a surface of an image carrier, and coordinates thereof expressed using a main-scanning position and a sub-scanning position thereof. A determination unit determines a correction value of a light power from the data of charging electric potentials at two or more points and coordinates thereof that have been read out from the storage unit. The correction value is applied to the light source so as to reduce the charging electric potential or the charging electric potential unevenness of coordinates on the surface of the image carrier. A correction unit uses the determined charging electric potential or correction value to correct the light power of the light source so as to mitigate an influence of charging unevenness at each set of coordinates.

6 Claims, 12 Drawing Sheets

IMAGE FORMING APPARATUS AND CONTROL METHOD THEREOF

BACKGROUND OF THE INVENTION

1. Field of the Invention

The present invention generally relates to image forming apparatuses and control methods thereof, and particularly relates to electrophotographic image forming apparatuses.

2. Description of the Related Art

Generally, APC (automatic power control), which makes uniform the amount of laser light during a single scan, is employed in image forming apparatuses in order to make uniform the density of images. However, even though control can be achieved to keep the amount of laser light uniform, this alone does not eliminate an effect of charging unevenness that occurs in the surface electric potential of a photosensitive drum. Charging unevenness refers to a phenomenon in which a charging electric potential does not become constant in a photosensitive drum that employs a-Si or the like as an image carrier. If this charging unevenness exceeds an allowable range, density unevenness occurs in the image that is formed. Japanese Patent Laid-Open No. 2005-66827 proposes a technique for reducing charging unevenness with respect to a main-scanning direction.

With the invention described above, there is an advantage in that the effect of charging unevenness in the main-scanning direction of the photosensitive drum can be reduced. However, in practice, charging unevenness can also occur in a sub-scanning direction. Accordingly, it is necessary to reduce the charging unevenness in the sub-scanning direction also in order to achieve further increases in image quality.

On the other hand, a storage unit such as a memory or the like is necessary in order to hold information relating to charging unevenness. Unfortunately, in order to store information concerning charging unevenness for not only the main-scanning direction but also the sub-scanning direction, a relatively large-capacity memory becomes necessary.

SUMMARY OF THE INVENTION

Accordingly, a feature of the present invention is to provide a solution for at least one issue among these and other issues. For example, it is a feature to reduce the amount of information relating to charging unevenness while reducing occurrences of density unevenness in images. It should be noted in regard to other issues that these will be evident from the specification overall.

The present invention for example is applied to an image forming apparatus including an image carrier, a charger that charges a surface of the image carrier, and a light source that irradiates a light modulated in response to an image signal on the surface of the charged image carrier.

A storage unit stores data of charging electric potentials at two or more points on a surface of an image carrier, and coordinates thereof expressed using a main-scanning position and a sub-scanning position thereof. A determination unit determines a correction value of a light power from the data of charging electric potentials at two or more points and coordinates thereof that have been read out from the storage unit. The correction value is applied to the light source so as to reduce the charging electric potential or the charging electric potential unevenness of coordinates on the surface of the image carrier. A correction unit uses the determined charging electric potential or correction value to correct the light power of the light source so as to mitigate an influence of charging unevenness at each set of coordinates.

Further features of the present invention will become apparent from the following description of exemplary embodiments with reference to the attached drawings.

DESCRIPTION OF THE EMBODIMENTS

An embodiment of the present invention is shown below. Each of the separate embodiments to be described below will be useful in understanding various concepts such as generic concepts, mid-level concepts, and subordinate concepts of the present invention. Furthermore, the technical scope of the present invention is to be established by the claims and not limited by the following separate embodiments.

Figure 1:
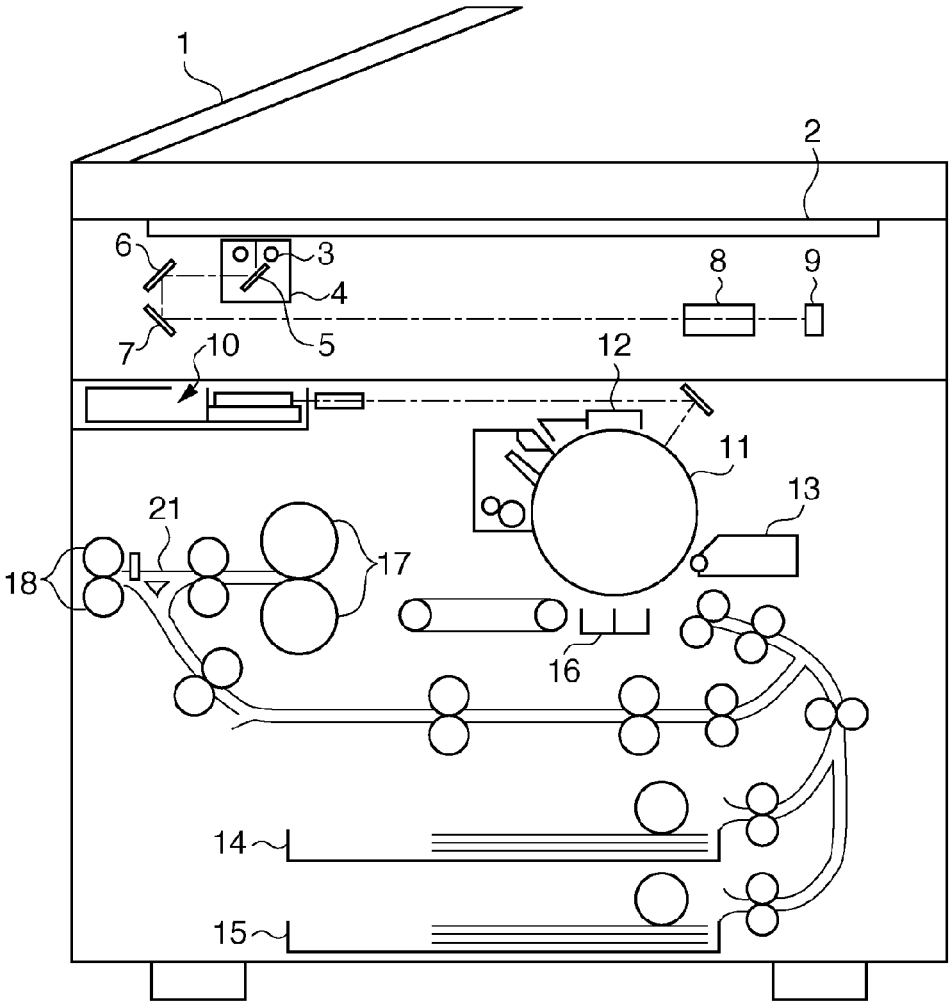
FIG. 1 is a cross-sectional view showing an overall structure of an image forming apparatus according to an embodiment.

FIG. 1 is a cross-sectional view showing an overall structure of an image forming apparatus according to an embodiment. The image forming apparatus may be realized as a printing apparatus, a printer, a copier, a multi-function peripheral, or a facsimile machine for example. Here description is given using a digital copier as an example.

Originals that have been loaded in an original sheet feeding unit 1 are conveyed sheet by sheet to an original stage glass 2. As originals are conveyed in, a lamp 3 for lighting originals, which is mounted in a scanner unit 4, switches on. Reflected light from the original is deflected to a mirror 6 by a mirror 5 that is mounted in the scanner unit 4. Then the reflected light further passes through a lens 8 via the mirror 6 and a mirror 7, and is incident on an image sensor unit 9. The image sensor unit 9 converts the reflected light to image signals and outputs to an exposure control unit 10. The exposure control unit is also sometimes referred to as an exposure device, a scanning optical device, or an optical scanning device.

The exposure control unit 10 emits light (light flux) that have been modulated in response to the image signals. The light flux is deflected and scanned in a main-scanning direction. A charger 12 uniformly charges a surface of a photosensitive member 11 that acts as an image carrier. An electrostatic latent image is formed on the photosensitive member 11 by irradiating light onto the surface of the uniformly charged photosensitive member 11. The photosensitive member 11 is one example of an image carrier. A developer 13 develops the latent image on the photosensitive member 11, thereby forming a developer (example: toner) image.

At a transfer unit 16, the toner image is transferred onto a print medium that has been conveyed in by a transfer member loading unit 14 or 15. The print medium may also be referred to as a print material, paper, sheets, transfer material, and transfer paper for example. Also, the material of the print medium may be paper, fiber, film, or resin or the like. After the transferred toner image has been fixed on the print medium by a fixing unit 17, the medium passes through a paper discharge conveying path 21 and is discharged outside from a discharge unit 18.

Figure 2:
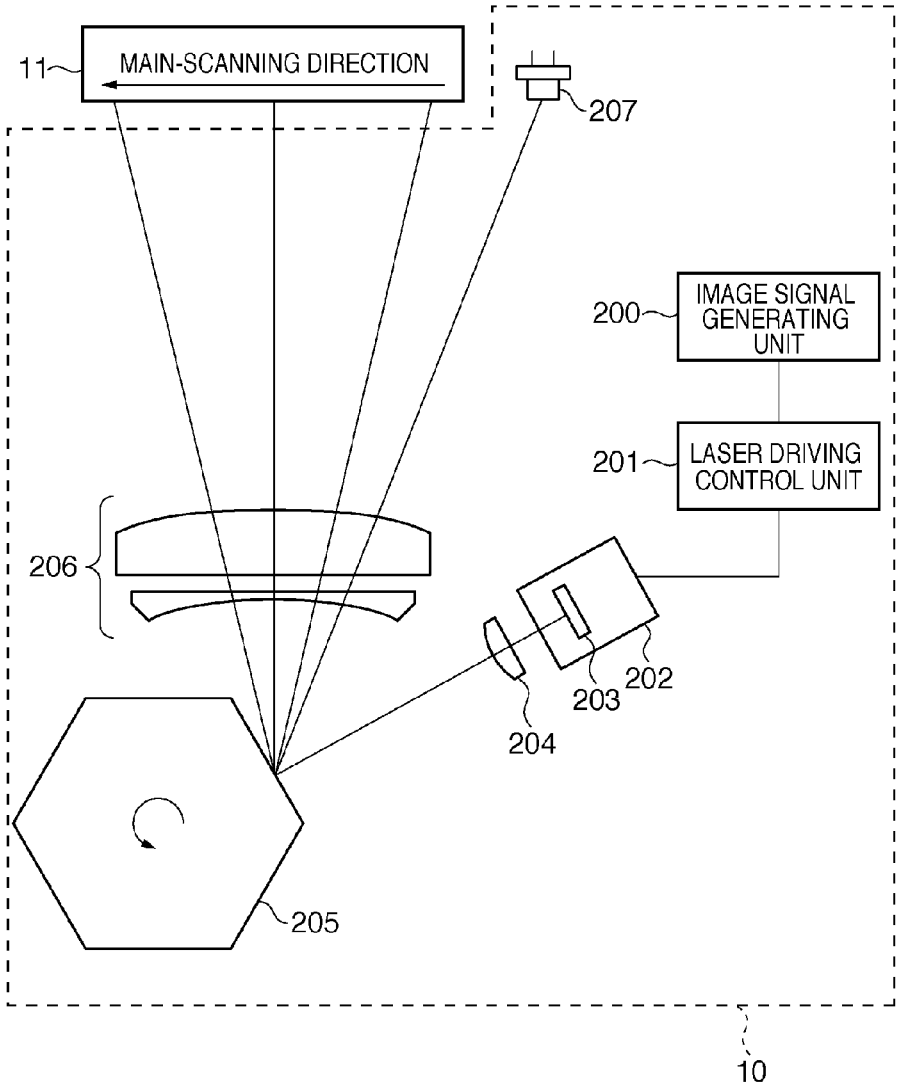
FIG. 2 is a diagram showing a configuration of an exposure control unit 10 according to the present embodiment.

FIG. 2 is a diagram showing a configuration of the exposure control unit 10 according to the present embodiment. An image signal generating unit 200 generates an image signal in response to the image data and outputs to a laser driving control unit 201. The laser driving control unit 201 outputs a laser driving signal corresponding to the inputted image signal to a laser light power control unit 202. The laser light power control unit 202 drives a semiconductor laser element 203 in response to the inputted laser driving signal. The semiconductor laser element 203 is one example of a light source that emits a light flux.

The laser beam outputted from the semiconductor laser element 203 is converted to substantially parallel light by a collimator lens 204 and is incident on a polygonal mirror 205 with a predetermined beam diameter. The laser beam is also referred to as a light beam or light flux, or simply light. The polygonal mirror 205 is one type of a rotating many-sided mirror. Instead of the polygonal mirror 205, a resonant type light deflection element or the like may be employed. The polygonal mirror 205 rotates in a direction indicated by an arrow. The polygonal mirror 205 reflects the incident laser beam as a deflected beam having a continuously changing angle. The deflected beam (scanning light) receives a focusing effect by an fθ lens 206. The fθ lens 206 converts the sinusoidal vibration of scanning light to a substantially uniform speed motion. The scanning light scans the photosensitive member 11 with a uniform speed in a direction shown by an arrow in the diagram (main-scanning direction).

A BD sensor 207 is a light-receiving element that detects the scanning light from the polygonal mirror 205. It should be noted that BD is an abbreviation of beam detect (beam detection). A detection signal outputted from the BD sensor 207 is used as a synchronization signal for synchronizing the scanning of the polygonal mirror 205 and the writing of the image data. In this manner, the BD sensor 207 is one example of a light detection unit that detects a light flux so as to determine an image writing timing in the main-scanning direction.

Charging Unevenness

Figure 3:
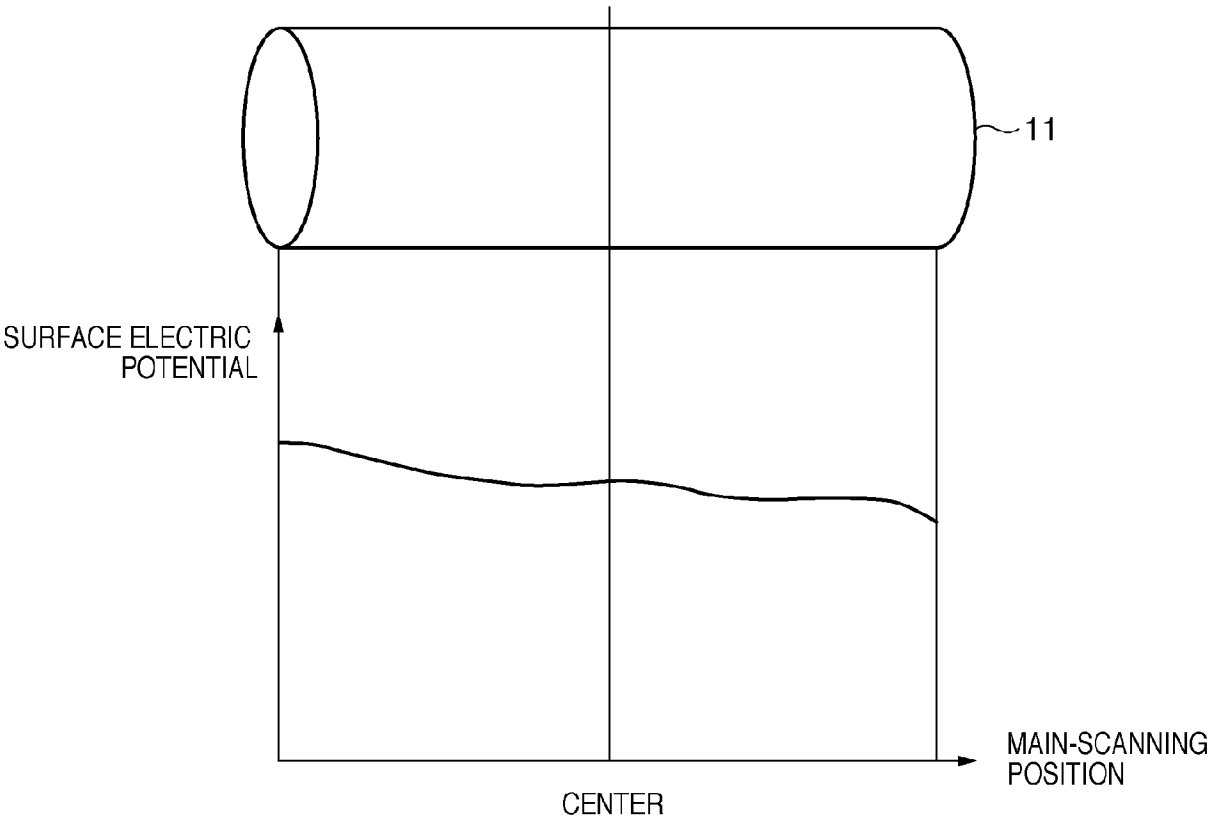
FIG. 3 is a diagram for describing charging unevenness that is produced in the main-scanning direction of the photosensitive member.

FIG. 3 is a diagram for describing charging unevenness that is produced in the main-scanning direction of the photosensitive member. As shown in FIG. 3, the charging electric potential (surface electric potential) of the surface of the photosensitive member 11 varies for each main-scanning position. When the surface electric potential is not uniform in this manner, the density of an image, which should be uniform, will not be uniform.

Figure 4:
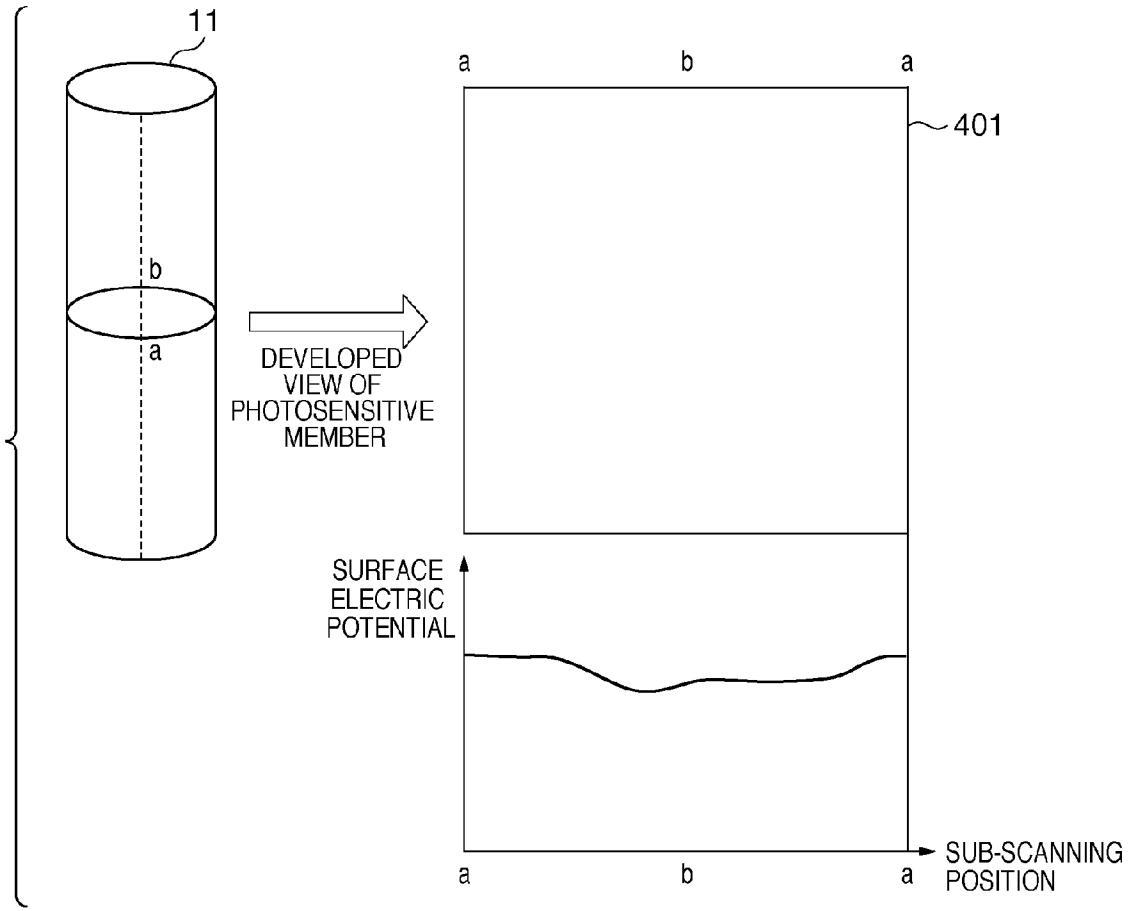
FIG. 4 is a diagram for describing charging unevenness that is produced in a sub-scanning direction of the photosensitive member.

FIG. 4 is a diagram for describing charging unevenness that is produced in a sub-scanning direction of the photosensitive member (which is a direction substantially orthogonal to the main-scanning direction and is a rotation direction of the photosensitive member). Numeral 401 in FIG. 4 indicates a developed view of the photosensitive member surface obtained by developing along a straight line that passes through a point a in a vertical direction. The photosensitive member 11 is a drum (cylinder) shape and therefore a developed view thereof is rectangular. As shown in FIG. 4, the surface electric potential of the photosensitive member 11 varies for each sub-scanning position.

When there is charging unevenness present not only in the main-scanning direction but also the sub-scanning direction in this manner, it is necessary to reduce the charging unevenness of both directions. This is because charging unevenness leads to unevenness in the density of the image that is formed. It should be noted that if the charging unevenness in the main-scanning direction is within an allowable range, it is possible to reduce only the charging unevenness in the sub-scanning direction. Conversely, if the charging unevenness in the sub-scanning direction is within an allowable range, it is possible to reduce only the charging unevenness in the main-scanning direction.

Embodiment 1

The Concept of Reducing Charging Unevenness Information

As shown in FIGS. 3 and 4, charging unevenness occurs not only in the main-scanning direction but also the sub-scanning direction. Supposing that a developed view of the surface of the photosensitive member 11 is a flat surface having main-scanning positions and sub-scanning positions as axes of coordinates, if there was data of charging unevenness at each set of coordinates, then the light power of the light source could be corrected with excellent accuracy so as to eliminate charging unevenness. However, if data of charging unevenness was to be stored in a storage unit for all coordinates, this would necessitate a storage unit having large storage capacity.

Accordingly, in the present embodiment, data of the charging electric potential at two or more points on the surface of the image carrier, and coordinate data thereof expressed using a main-scanning position and a sub-scanning position, are stored in advance in a storage unit. Then, the charging electric potential for each set of coordinates on the surface of the image carrier is determined from the charging electric potential at the two or more points and the data of the coordinates thereof. The light power may be directly corrected from the value of the charging electric potential, or a correction value of the light power may be determined from the charging electric potential so that the light power is corrected based on the correction value. The difference between these is only whether the charging electric potential is used directly or whether it is used indirectly, and there is no difference in that both are based on the charging electric potential.

Figure 5:
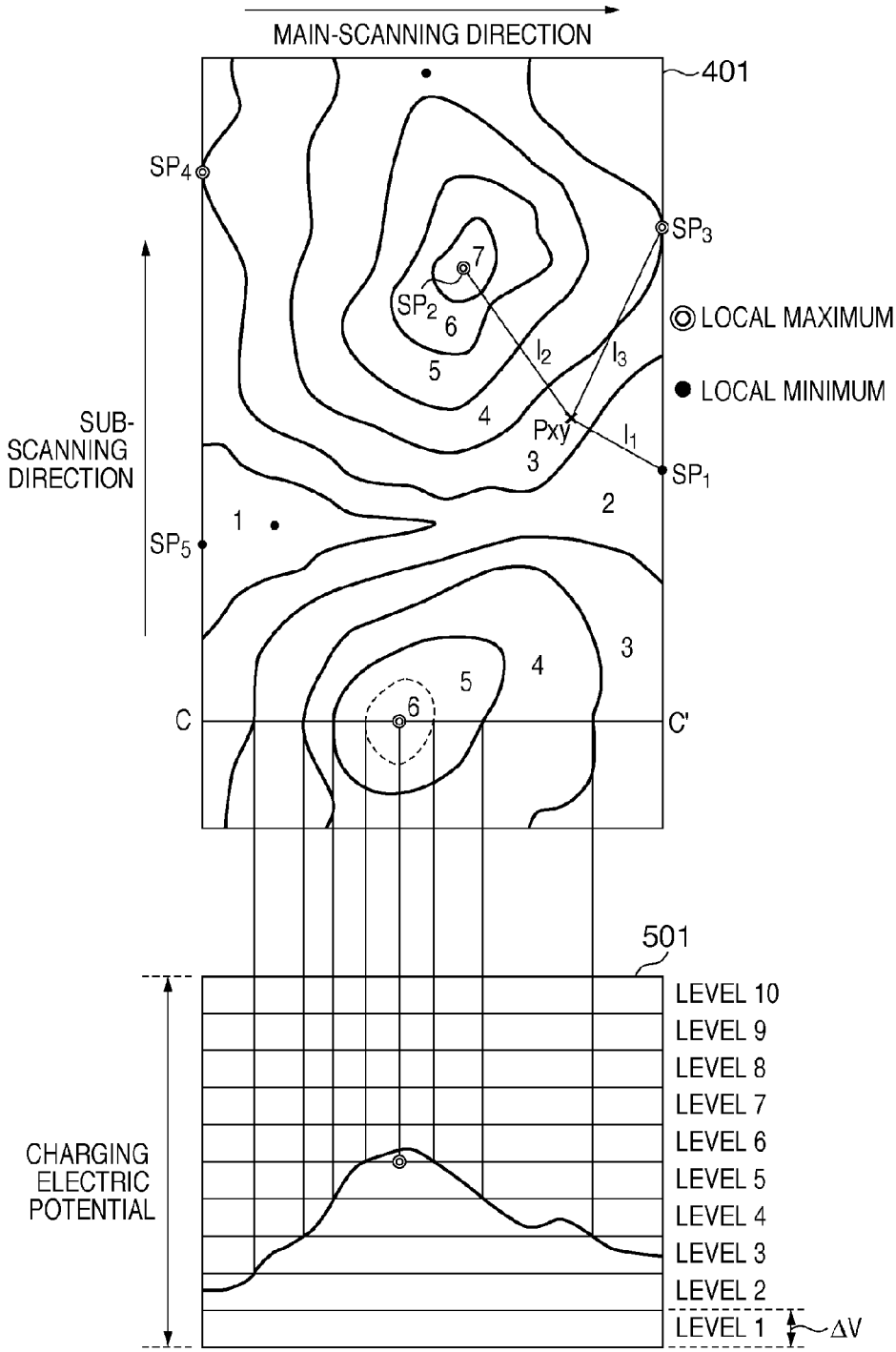
FIG. 5 is a conceptual diagram showing one example of a method for determining charging unevenness data according to the present embodiment.

FIG. 5 is a conceptual diagram showing one example of a method for determining charging unevenness information according to the present embodiment. In a developed view, the charging electric potential for each set of coordinates on the surface of the photosensitive member 11 is shown by a contour line. It should be noted that the contour line indicates a magnitude (height) of electric potential and therefore may also be referred to as an equipotential line. The developed view further shows multiple sets of local maximums and local minimums of charging electric potential. It should be noted that the numerical values in the diagram indicate the magnitude (height) of the charging electric potential at that point. In this way, the charging electric potential on the surface of the photosensitive member 11 can be expressed using a three-dimensional model in which a plurality of contour lines are set. Conceptually, the local maximums correspond to "mountains" or "hills" of charging unevenness, while the local minimums correspond to "valleys" or "depressions" of charging unevenness.

Intervals ΔV between the contour lines are constant intervals. The intervals are electric potential differences of an allowable limit by which density unevenness will not be caused, such as 5 [V] for example. In FIG. 5, the charging electric potential is divided into 10 stages, from level 1 to level 10. The lower part of FIG. 5 shows a cross-sectional view obtained when the three-dimensional model shown in the developed view is cross-sectioned c-c'. Numeral 501 indicates this cross-sectional view.

As shown in the cross-sectional view, a local maximum and a local minimum are in fact present at level 4. However, in the developed view, the local maximum and the local minimum are not shown. In the present embodiment, of the plurality of local maximums and local minimums, those where the difference between a local maximum and a local minimum having neighboring coordinates is less than a prescribed value are excluded from being stored. That is, of the plurality of local maximums and local minimums that can be produced on the surface of the image carrier, only those where the difference between a local maximum and a local minimum having neighboring coordinates is a prescribed value or higher are stored in the storage unit. If the prescribed value is set to an allowable limit ΔV, change that is less than the allowable limit can be disregarded from a perspective of density unevenness. That is, undulations that are less than ΔV can be considered as change within an allowable range. Accordingly, the data of local maximums and local minimums that can be disregarded is excluded from being stored, thereby further reducing the required storage capacity.

In the present embodiment, a charging electric potential Vxy of a point Pxy to be determined is calculated from the charging electric potentials of a plurality of points close in distance. That is, a local maximum and local minimum associated with coordinates relatively close in distance to coordinates to be determined are selected among a plurality of local maximums and local minimums that are stored in the storage unit. The points used in the calculations are referred to as sampling points (hereinafter abbreviated to SP).

The coordinates of a first sampling point SP1 are set to (X1, Y1, V1). The coordinates of a second sampling point SP2 are set to (X2, Y2, V2). The coordinates of a third sampling point SP3 are set to (X3, Y3, V3). X1, X2, and X3 indicate main-scanning positions. Y1, Y2, and Y3 indicate sub-scanning positions. V1, V2, and V3 indicate charging electric potentials. In this case, Vxy is calculated from the following expression (1).

$$V_{xy} = \frac{\frac{1}{L_1}V_1 + \frac{1}{L_2}V_2 + \frac{1}{L_3}V_3}{\frac{1}{L_1} + \frac{1}{L_2} + \frac{1}{L_3}} \quad (1)$$

Here, L1 indicates a distance between SP1 and Pxy. L2 indicates a distance between SP2 and Pxy. L3 indicates a distance between SP3 and Pxy. In this manner, the charging electric potential Vxy is calculated as an average value of weighted charging electric potentials by carrying out weighting of the charging electric potentials at sampling points based on distance.

Figure 6:
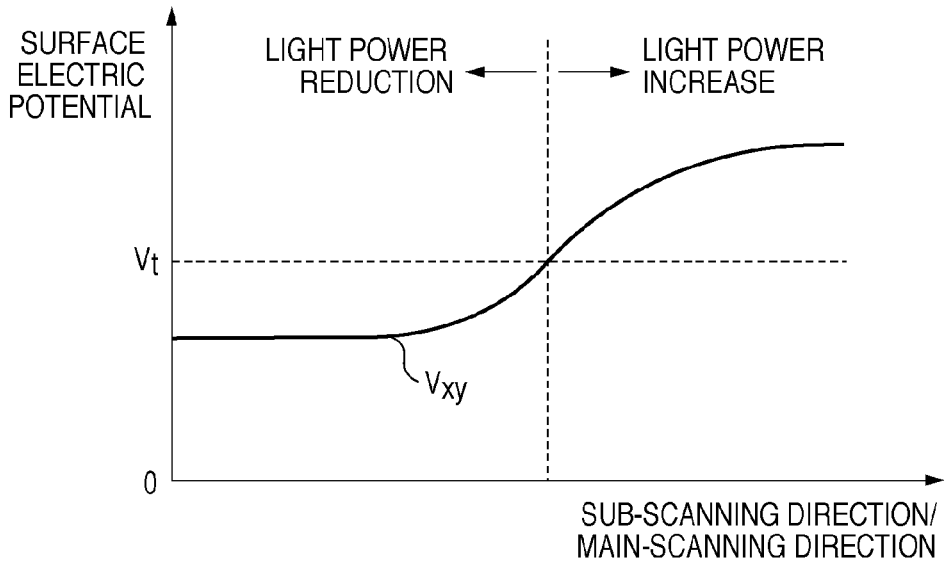
FIG. 6 is a diagram for describing a concept of light power correction according to the present embodiment.

FIG. 6 is a diagram for describing a concept of light power correction according to the present embodiment. As shown in FIG. 6, at coordinates of surface electric potentials less than a target electric potential Vt, the light power is corrected such that the light power is reduced. That is, if the surface electric potential is less than the target electric potential Vt, a charge that is cut off by exposure is reduced by lessening the light power. On the other hand, at coordinates of surface electric potentials exceeding the target electric potential Vt, the light power is corrected such that the light power is increased. That is, if the surface electric potential exceeds the target electric potential Vt, a charge that is cut off by exposure is increased by increasing the light power. Due to these, electric potential unevenness in the electrostatic latent image that is to be finally formed is reduced and therefore density unevenness is also mitigated.

A light power correction value Axy is determined for example from an amount of difference between the calculated charging electric potential Vxy and the target electric potential Vt. An expression for calculating the light power correction value Axy is shown below, but this expression is merely an example. That is, a more complicated expression may be employed. It should be noted that C in this expression is a coefficient.

$$Axy = C(Vt - Vxy) \quad (2)$$

Figure 7:
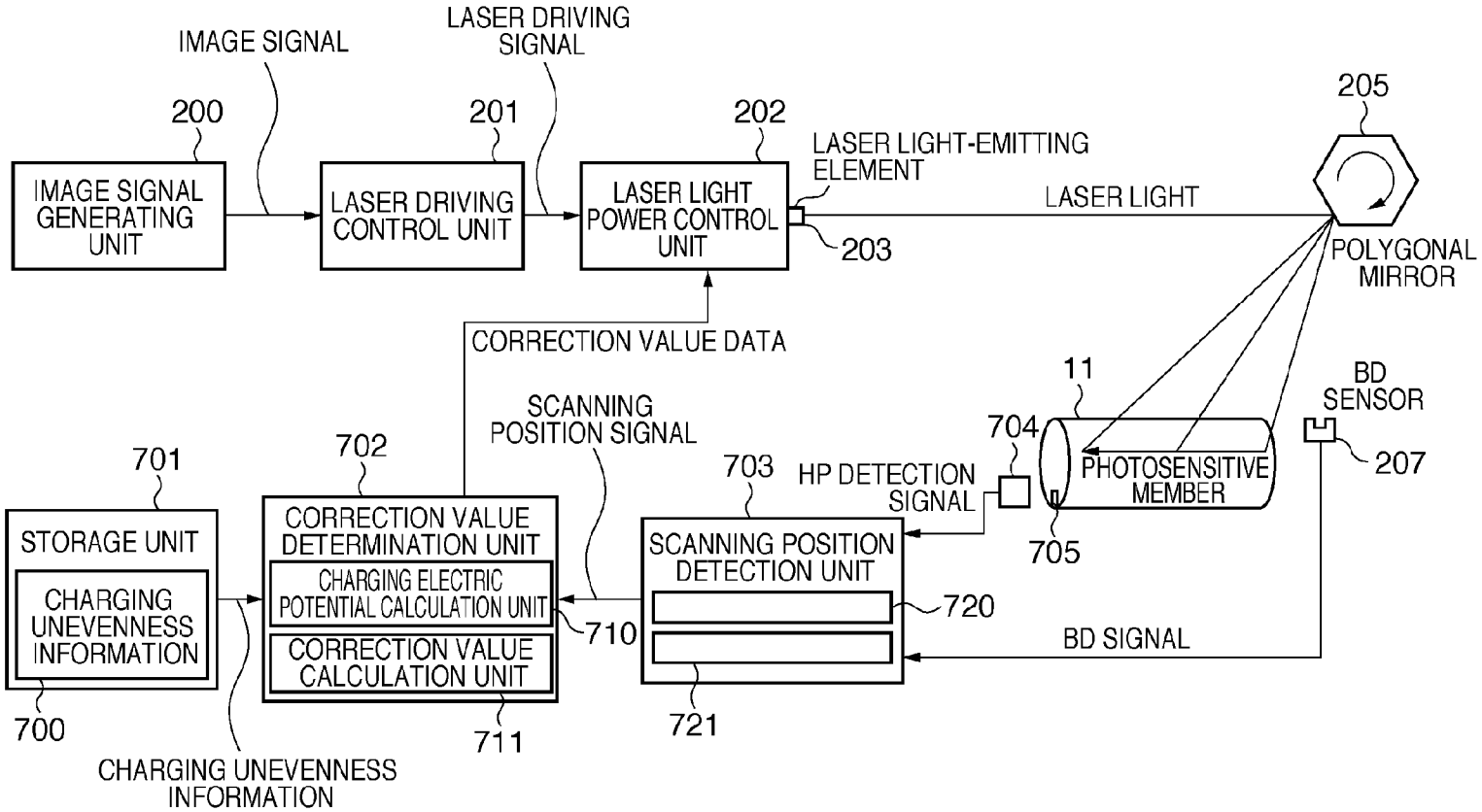
FIG. 7 is a block diagram showing an illustrative example of a control unit according to the present embodiment.

FIG. 7 is a block diagram showing an illustrative example of a control unit according to the present embodiment. The same reference symbols are applied to items that have already been described. A storage unit 701 is a memory, hard disk drive, or other storage device. The storage unit 701 is one example of a storage unit in which data of the charging electric potential at two or more points on the surface of the image carrier, and coordinates thereof expressed using a main-scanning position and a sub-scanning position, is stored.

For example, the storage unit 701 may store local maximums and local minimums of charging electric potentials on the surface of the photosensitive member 11 as shown in FIG. 5 and charging unevenness information 700 grouped with data of coordinates thereof. Data of charging electric potentials for all coordinates may be stored as the charging unevenness information 700, but in the case, the required storage capacity increases undesirably. If data of only some local maximums and local minimums is stored as in the present embodiment, there is an advantage in that the required storage capacity can be reduced.

It should be noted that as shown in FIG. 5, the local maximums SP3 and SP4 of the sub-scanning direction at both ends (left end and right end) in the main-scanning direction of the photosensitive member 11 as well as the coordinate data thereof, and the local minimums SP1 and SP5 and the coordinate data thereof are stored in the storage unit 701. Both ends in the main-scanning direction are references for image forming. Accordingly, the values of the local maximums and local minimums of both ends in the sub-scanning direction and the coordinates thereof can be effective in determining with excellent accuracy the charging electric potentials at other coordinates.

It is preferable that the coordinates of the local maximums and local minimums to be stored are the center of gravity of the plane in the level in which the local maximums and local minimums are contained. That is, the center of gravity of the plane obtained when cutting off a three-dimensional model along a contour line corresponding to a local maximum or a local minimum becomes the coordinates of the local maximum or the local minimum. For example, the coordinates of SP2 are a center of gravity of a cross-sectional area obtained when cutting off a three-dimensional model along a contour line of level 7. The three-dimensional model of charging electric potential is expressed using contour lines of constant intervals and therefore error due to model formation may be present. Accordingly, using the area center of gravity as the coordinates of the local maximums and the local minimums is advantageous in mitigating further error.

From data of charging electric potentials at two or more points and coordinates thereof, which is read out from the storage unit, a correction value determination unit 702, which is one example of a determination unit, determines correction values for the light power of a light source, which are applied so as to reduce the charging electric potential or the charging electric potential unevenness at coordinates on the surface of the image carrier. The correction value determination unit 702 reads out from the storage unit 701 charging unevenness information corresponding to scanning position signals outputted from a scanning position detection unit 703 for example, and determines data of charging electric potential of each set of coordinates from the charging unevenness information that has been read out. The scanning position signals contain information indicating coordinates (main-scanning position, sub-scanning position) to be processed.

For example, a charging electric potential calculation unit 710 calculates a distance between coordinates to be processed (coordinates of interest) and coordinates stored in the storage unit 701, and selects a plurality of (for example, three) sets of coordinates closest in distance. That is, the charging electric potential calculation unit 710 functions also as a selection unit. Further still, the charging electric potential calculation unit 710 reads out from the storage unit 701 data of charging electric potentials associated with the selected coordinates for example, and calculates the charging electric potential Vxy by substituting in this data to the aforementioned expression (1).

A correction value calculation unit 711 calculates the correction value Axy by substituting in the calculated values of charging electric potentials for example to the aforementioned expression (2). The correction value data is outputted to the aforementioned laser light power control unit 202. The laser light power control unit 202 increases or decreases a target value of light power in accordance with the inputted data of correction values. In this way, the surface electric potential of the latent image formed by exposure approaches a surface electric potential of a latent image formed on a photosensitive member having little charging unevenness. In other words, density unevenness in the finally formed image is reduced. It should be noted that the correction value calculation unit 711 and the laser light power control unit 202 are each one example of correction units that use the determined charging electric potentials or correction values to correct the light power of the light source so as to mitigate the influence of charging unevenness at each set of coordinates.

The scanning position detection unit 703 detects a current scanning position in response to an HP detection signal outputted from a home position sensor 704 and a BD signal outputted from the BD sensor 207. The home position sensor 704 outputs the HP detection signal each time a mark provided in the home position of the photosensitive member 11 is detected. The HP detection signal is outputted one time for each single rotation of the photosensitive member 11. It should be noted that HP is an abbreviation for home position. The BD sensor 207 outputs the BD signal each time the scanning light is irradiated from the polygonal mirror 205. That is, the BD signal provides a reference of the main-scanning position.

A sub-scanning position counter 720 is a counter that is reset (initialized) when the HP detection signal is inputted and is incremented by one count value when the BD signal is inputted. That is, the count value of the sub-scanning position counter 720 indicates a current absolute sub-scanning position. A main-scanning position counter 721 is a counter that is reset when the BD detection signal is inputted and is incremented by one count value in response to a clock signal. That is, the count value of the main-scanning position counter 721 indicates a current absolute main-scanning position.

Figure 8:
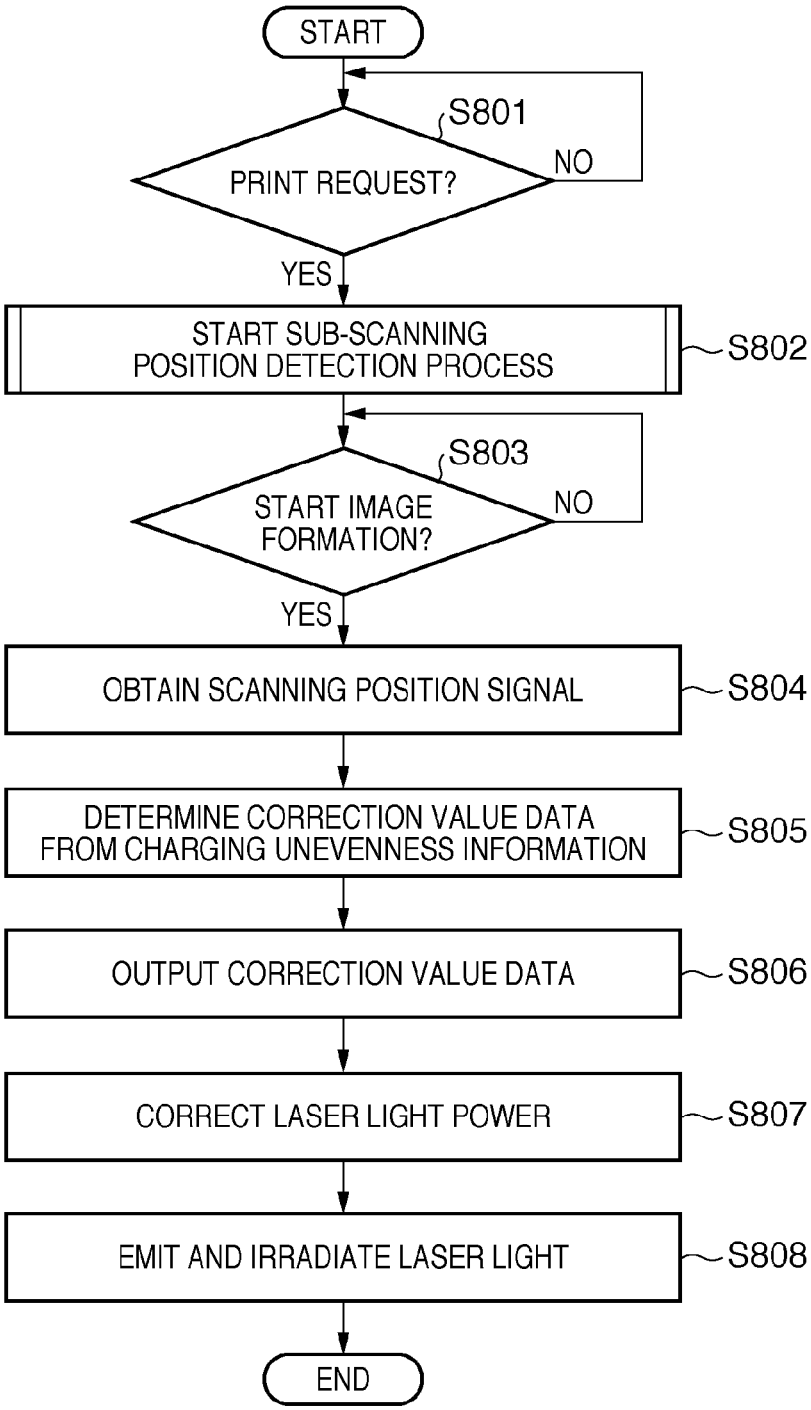
FIG. 8 is a flowchart showing one example of a control method according to the present embodiment.

FIG. 8 is a flowchart showing one example of a control method according to the present embodiment. At step S801, the image signal generating unit 200 is on standby until a print request is inputted, when a print request is inputted, the procedure proceeds to step S802. At step S802, the scanning position detection unit 703 starts detection processing of the sub-scanning position of the photosensitive member. At step S803, the image signal generating unit 200 decides whether or not image formation should start. When image formation preparation is ready, the procedure proceeds to step S804.

At step S804, the correction value determination unit 702 obtains the scanning position signal from the scanning position detection unit 703. At step S805, the correction value determination unit 702 reads out from the storage unit 701 the charging unevenness information 700 corresponding to the obtained scanning position signal and determines a correction value. At step S806, the correction value determination unit 702 outputs data of the determined correction value to the laser light power control unit 202.

At step S807, the laser light power control unit 202 corrects the laser light power in response to the inputted correction value data. At step S808, the laser light power control unit 202 irradiates laser light from the semiconductor laser element 203. It should be noted that step S804 to step S808 are executed repetitively until image forming is completed. During this time, the sub-scanning position and the main-scanning position are incremented successively by one value each.

Figure 9:
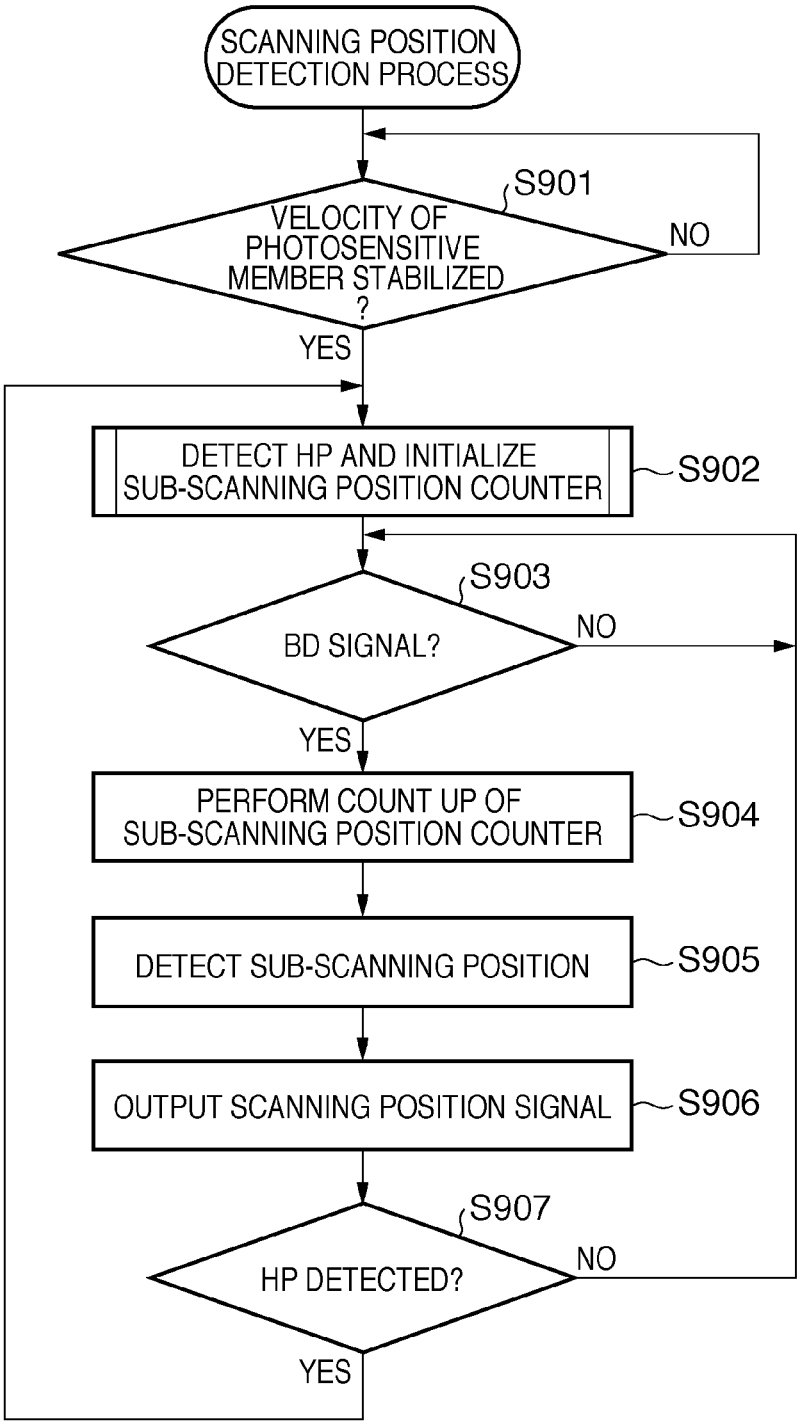
FIG. 9 is a flowchart showing one example of a scanning position detection process according to the present embodiment.

FIG. 9 is a flowchart showing one example of a scanning position detection process according to the present embodiment. The scanning position detection process starts at the above-described step S802 and is executed in parallel with the main processing shown in FIG. 8.

At step S901, the image signal generating unit 200 starts rotation of the photosensitive member 11 and waits until the rotation velocity of the photosensitive member 11 stabilizes. When the rotation velocity stabilizes, the procedure proceeds to step S902. At step S902, the scanning position detection unit 703 initializes the sub-scanning position counter 720 when the HP detection signal is outputted from the home position sensor 704. The sub-scanning position counter 720 starts the count. The count value of the sub-scanning position counter 720 indicates an absolute sub-scanning position.

At step S903, the scanning position detection unit 703 waits until a BD signal is inputted from the BD sensor 207. When a BD signal is inputted, the procedure proceeds to step S904. At step S904, the sub-scanning position counter 720 is counted up (incremented) by one. At step S905, the scanning position detection unit 703 detects the current sub-scanning position by obtaining the current count value from the sub-scanning position counter 720.

At step S906, the scanning position detection unit 703 generates a scanning position signal indicating the current sub-scanning position and outputs to the laser light power control unit 202. At step S907, the scanning position detection unit 703 decides whether or not the HP detection signal has been inputted again. If the HP detection signal has not been inputted again, the procedure returns to step S903. If the HP detection signal has been inputted again, the procedure returns to step S902.

With the present embodiment, charging unevenness information of a portion of coordinates that have been stored are used to obtain charging unevenness information of other coordinates, thereby enabling the amount of charging unevenness information that must be stored to be reduced. Further still, with the present embodiment, charging unevenness can be mitigated not only in the main-scanning direction but also the sub-scanning direction, and therefore it is possible to reduce occurrences of density unevenness in images.

For example, if data of one or more local maximums and the coordinates thereof as well as data of one or more local minimums and the coordinates thereof are stored, the charging electric potential at other coordinates can be determined with excellent accuracy. Local maximums and local minimums correspond to "mountains" and "valleys" in charging unevenness, and therefore are particularly important data from a perspective of reducing charging unevenness. Accordingly, it is desirable to store raw data in regard to at least data of local maximums and local minimums. On the other hand, in regard to coordinates having charging electric potentials that are not local maximums or local minimums, their effect on density unevenness is relatively small and therefore may be estimated from charging electric potentials that are stored. In this way, occurrences of density unevenness can be reduced while reducing the required storage capacity.

It should be noted that in calculating the charging electric potential at an arbitrary set of coordinates, it is preferable to use a more appropriate value among the plurality of local maximums and local minimums stored in the storage unit. For example, it is preferable to select the local maximum and the local minimum of coordinates relatively close to the coordinates to be determined. As shown in FIG. 5, charging unevenness changes continuously, and therefore it is considered that using the local maximum and the local minimum having nearby coordinates enables the charging electric potential at the coordinates of interest to be calculated with excellent accuracy.

It should be noted that further measures may be employed to reduce the storage capacity. For example, of the plurality of local maximums and local minimums that can be produced on the surface of the image carrier, only those where the difference between a local maximum and a local minimum having neighboring coordinates is a prescribed value or higher may be stored in the storage unit. This is because local maximums and local minimums less than the prescribed value can be considered to be within an allowable range from a perspective of producing density unevenness. This is similar to the fact that small undulations (hills or valleys) in the mid-slopes of a mountain do not exert an influence on the overall shape of the mountain. In this manner, it is preferable that the prescribed value is an electric potential difference of a range in which an influence will not be exerted on the density of the image that is formed.

In the foregoing embodiment, the charging electric potential of the surface of the image carrier was expressed using a three-dimensional model in which the prescribed value was applied to a plurality of contour lines of constant intervals. A three-dimensional model such as this can be considered useful in grasping physical properties of charging unevenness. It should be noted that when a three-dimensional model is cut off using contour lines in which coordinates of a local maximum or a local minimum are present, the cross section thereof is a plane surface. By setting the center of gravity of the plane surface as the coordinates of the local maximum or the local minimum, it should be possible to reduce an influence of error that accompanies making a three-dimensional model of charging electric potential.

Embodiment 2

In the present embodiment, description is given regarding a method for reducing storage capacity by introducing another three-dimensional model expressing charging electric potential.

Figure 10:
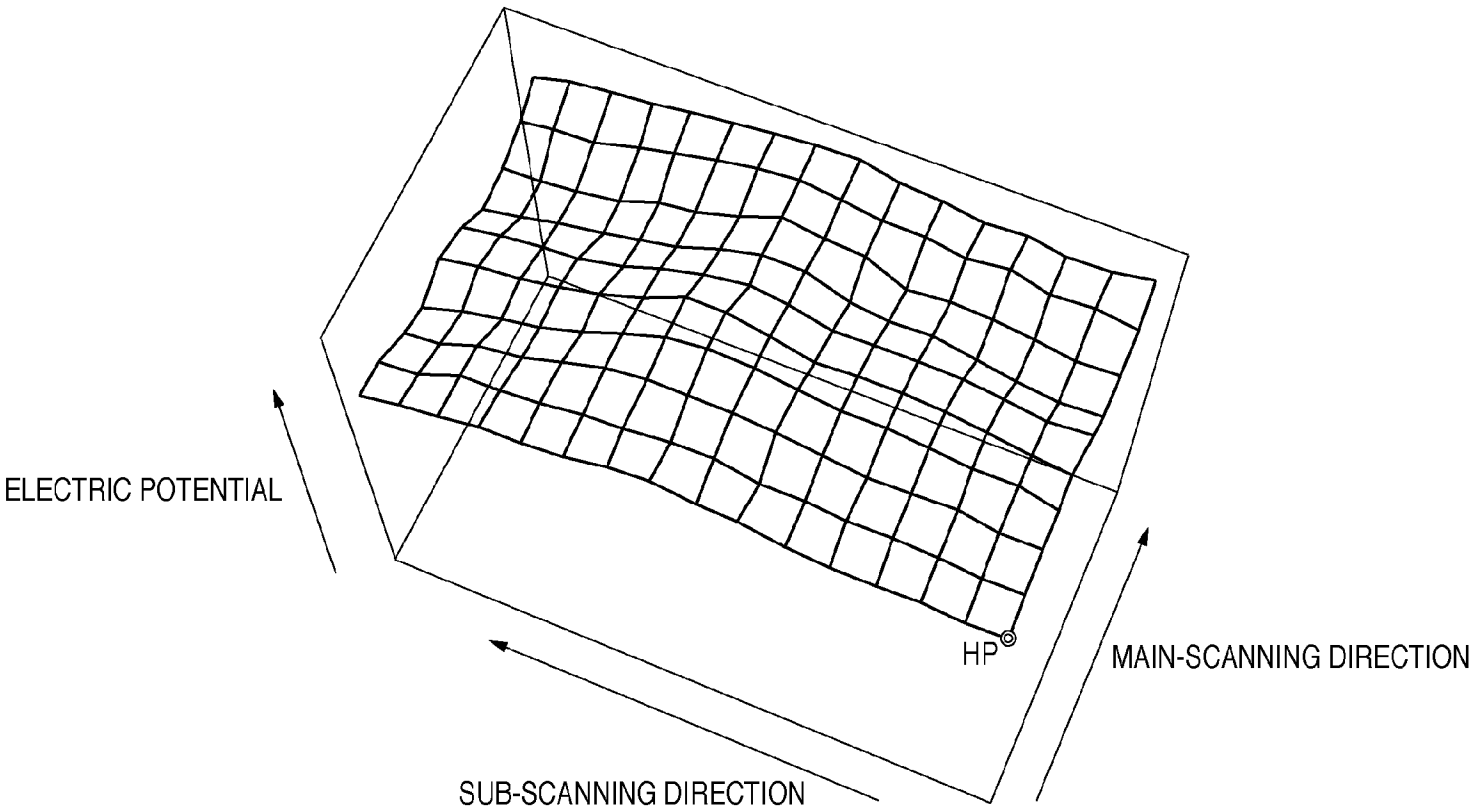
FIG. 10 is a diagram showing one example of a three-dimensional model expressing charging electric potential according to embodiment 2.

FIG. 10 is a diagram showing one example of a three-dimensional model expressing charging electric potential according to embodiment 2. This three-dimensional model is provided with an axis expressing the main-scanning direction, an axis expressing the sub-scanning direction, and an axis expressing charging electric potential. Characteristic here is that the coordinates of charging electric potential to be stored in the storage unit 701 are arranged in a grid form. That is, intersection points of the grid are the aforementioned sampling points. The intervals of the grid are a first interval in the main-scanning direction and a second interval in the sub-scanning direction.

Figure 11:
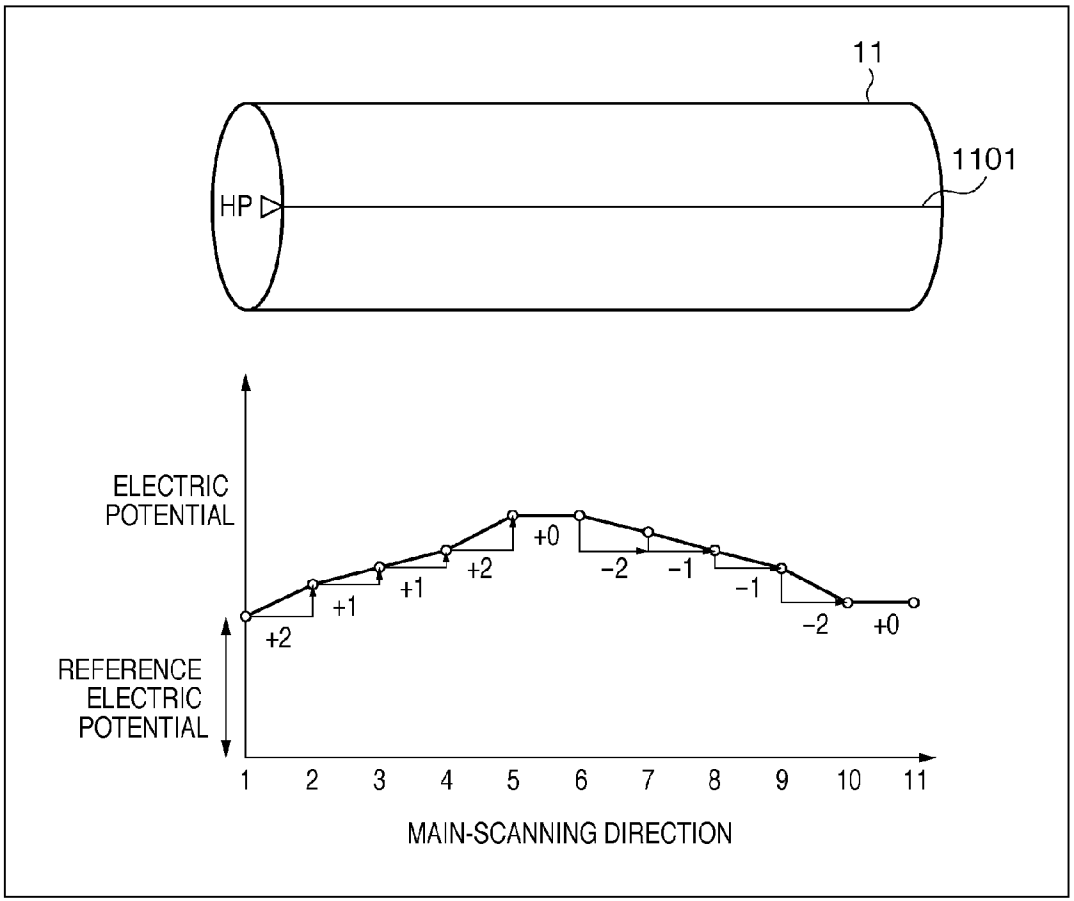
FIG. 11 is a diagram showing one example of charging electric potential in the main-scanning direction.

FIG. 11 is a diagram showing one example of charging electric potential in the main-scanning direction. Here, the sub-scanning direction coordinates are the same as the coordinates of the home position. That is, attention is given here to the coordinates on a locus 1101 of the scanning light that passes the home position.

As evident from the diagram, the charging electric potential of a first sampling point in the main-scanning direction is set as a reference electric potential. The charging electric potentials of a second sampling point onward can be expressed using a sign of a gradient and the electric potential difference from the preceding adjacent (adjacent on the left in FIG. 11) sampling point. By using numerical values in this manner, it becomes easier to reduce the storage capacity rather than storing the actual charging electric potentials as they are.

Figure 12:
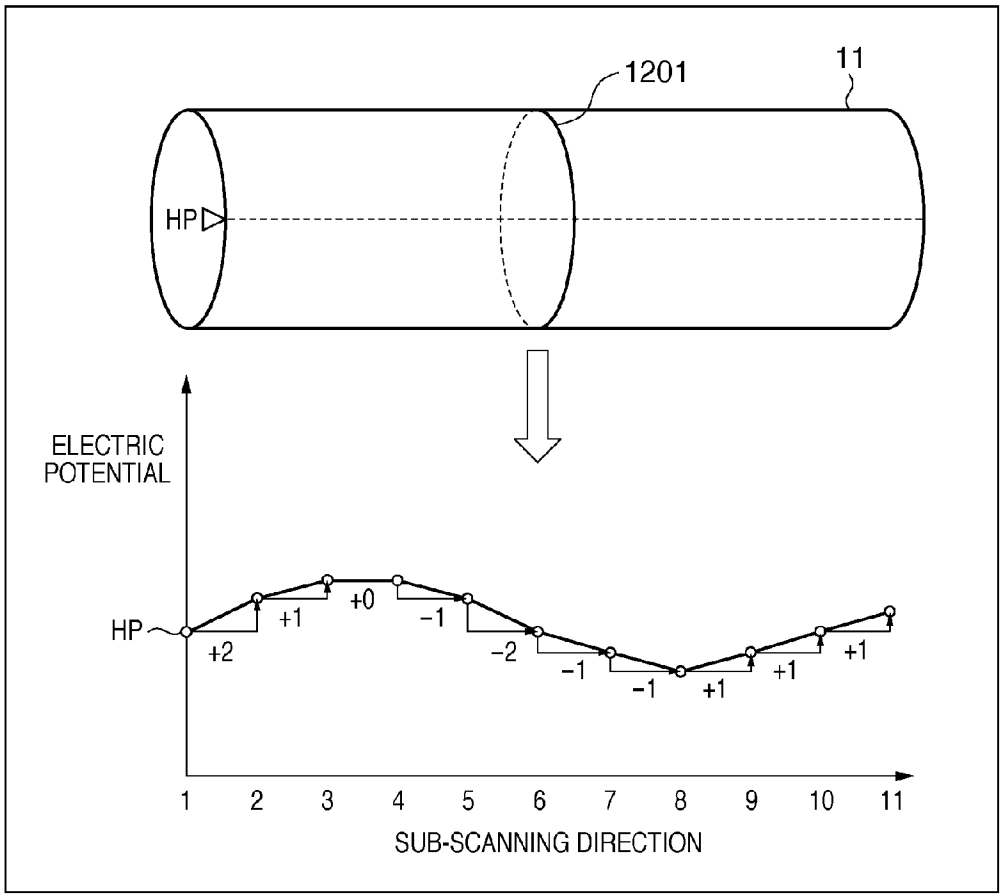
FIG. 12 is a diagram showing one example of charging electric potential in the sub-scanning direction.

FIG. 12 is a diagram showing one example of charging electric potential in the sub-scanning direction. Here, the main-scanning direction coordinates are coordinates on a locus 1201 of intersection points between a plane surface that passes through the center of the photosensitive member 11 and is perpendicular to the rotation axis of the photosensitive member 11 and the photosensitive member 11. Note however that this is merely one example. The charging electric potentials of coordinates in the sub-scanning direction also can be expressed using a sign of a gradient and the electric potential difference from the preceding adjacent (adjacent on the left in FIG. 12) sampling point.

In this manner, the reference electric potential of coordinates corresponding to the home position and signs expressing a gradient and the electric potential difference to the charging electric potential of the preceding adjacent coordinates for other sets of coordinates are stored as the aforementioned charging unevenness information 700 by the storage unit 701. Consequently, the correction value determination unit 702 first determines the charging electric potentials of the other sampling points in which the home position and the sub-scanning direction coordinates are equivalent. Next, the correction value determination unit 702 calculates the charging electric potential for other sampling points of a next line in the sub-scanning direction from information of the determined charging electric potential and information of the electric potential difference and signs that are stored.

It should be noted that it is not necessary for the storage unit 701 to store electric potential difference information and sign information for all the sampling points. That is, the charging electric potential of another sampling point positioned between two stored sampling points can be calculated by performing linear interpolation on two corresponding charging electric potential values.

With the present embodiment, the storage capacity can be reduced by expressing data of charging electric potentials to be stored in the storage unit, using the electric potential difference and a sign of the charging electric potential adjacent in the main-scanning direction, the charging electric potentials being obtained for each of a first interval in the main-scanning direction of the surface of the photosensitive member 11.

Furthermore, the storage capacity can be further reduced by expressing data of charging electric potentials to be stored, using the electric potential difference and a sign of the charging electric potential adjacent in the sub-scanning direction, the charging electric potentials being obtained for each of a second interval in the sub-scanning direction of the surface of the photosensitive member 11.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-180156, filed Jul. 9, 2007, which is hereby incorporated by reference herein in its entirety.

What is claimed is:

1. An image forming apparatus, comprising:

an image carrier;

a charger that charges a surface of said image carrier;

a light source that emits a light modulated in response to an image signal and irradiates the light on the surface of said charged image carrier;

a storage unit that stores a plurality of location data as coordinates comprising a main-scanning position and a sub-scanning position on the surface of said image carrier and stores data of a charging electric potential associated with the plurality of location data, wherein the plurality of location data and the data of the charging electric potential comprise local maximums of the data of the charging electric potential at coordinates of the plurality of location data associated with the local maximums, and further comprises local minimums of the data of the charging electric potential at coordinates of the plurality of location data associated with the local minimums;

a determination unit that determines from the data of the charging electric potential, which has been read out from said storage unit, one or more correction values of a light power of said light source to be applied so as to reduce a charging electric potential of coordinates on the surface of said image carrier or a charging electric potential unevenness of coordinates on the surface of said image carrier; and a correction unit that uses the determined correction value (s) to correct the light power of said light source so as to mitigate an influence of charging unevenness at each of the coordinates on the surface of said image carrier, wherein the local maximums and the local minimums of the data of the charging electric potential stored in said storage unit exclude at least some in which a difference between a local maximum and a local minimum having neighboring coordinates is less than a prescribed value.

2. The image forming apparatus according to claim 1, wherein said determination unit further comprises a selection unit that selects, from among a plurality of points identifying local maximums and local minimums of the data of the charging electric potential stored in said storage unit, the local maximum and the local minimum relatively close to coordinates on the surface of said image carrier whose charging electric potentials are to be determined as part of the determination unit determining the correction value(s).

3. The image forming apparatus according to claim 1, wherein the data of the charging electric potential is expressed as a three-dimensional model in which the charging electric potential is defined with a plurality of contour lines, and a center of gravity of a plane obtained from a single contour line corresponding to a local maximum or a local minimum is set as coordinates of the local maximum or the local minimum.

4. The image forming apparatus according to claim 3, wherein each contour line in the data represents a charging electric potential range.

5. The image forming apparatus according to claim 1, wherein the data of the charging electric potential stored in said storage unit represents a difference of charging electric potential in adjacent positions in a main-scanning direction of the surface of said image carrier, the charging electric potential being obtained for each of a plurality of first intervals in the main-scanning direction of the surface of said image carrier.

6. The image forming apparatus according to claim 1, wherein the data of the charging electric potential stored in said storage unit represents a difference of charging electric potential in adjacent positions in a sub-scanning direction of the surface of said image carrier, the charging electric potential being obtained for each of a plurality of second intervals in the sub-scanning direction of the surface of said image carrier.

* * * * *